United States Patent [19]

Navelsaker

[11] 3,964,836

[45] June 22, 1976

[54] METHOD OF PUMPING LIQUID WITH A SUBMERGED ROTARY PUMP AND PUMP FOR CARRYING OUT THE METHOD

[75] Inventor: Olav Rasmusson Navelsaker, Oslo, Norway

[73] Assignee: Thune-Eureka A/S, Oslo, Norway

[22] Filed: Feb. 5, 1974

[21] Appl. No.: 439,764

[30] Foreign Application Priority Data

July 5, 1973 Norway ..... 2765/73

[52] U.S. Cl. ..... 415/1; 415/213 T; 415/143; 417/424

[51] Int. Cl.[2] ..... F01D 25/00; F04B 47/06

[58] Field of Search ..... 415/143, 1, 213 T, 198; 417/424

[56] References Cited

UNITED STATES PATENTS

| | | | |
|---|---|---|---|
| 2,208,057 | 7/1940 | Skitch | 415/213 T |
| 3,102,481 | 9/1963 | Stoner et al. | 415/143 |
| 3,132,493 | 5/1964 | Peckham et al. | 415/143 |
| 3,250,440 | 5/1966 | Trout | 415/143 |
| 3,369,715 | 2/1968 | Carter | 415/143 |
| 3,435,771 | 4/1969 | Riple | 415/143 |

*Primary Examiner*—C. J. Husar
*Attorney, Agent, or Firm*—Young & Thompson

[57] ABSTRACT

By pumping a liquid with a submerged rotary pump the distance from the submerged pump to the top of the riser pipe can be substantial and the liquid column left in the riser pipe from the pump constitutes a not insignificant residue. When the liquid level in the tank has sunk to the pump, the liquid in the riser pipe is caused to pass down into the pump and into and up through a relatively narrow pipe which leads from the pump housing at the pressure side of the pump impeller, the rotary impeller acting as check valve for the liquid.

6 Claims, 2 Drawing Figures

Figure 1:
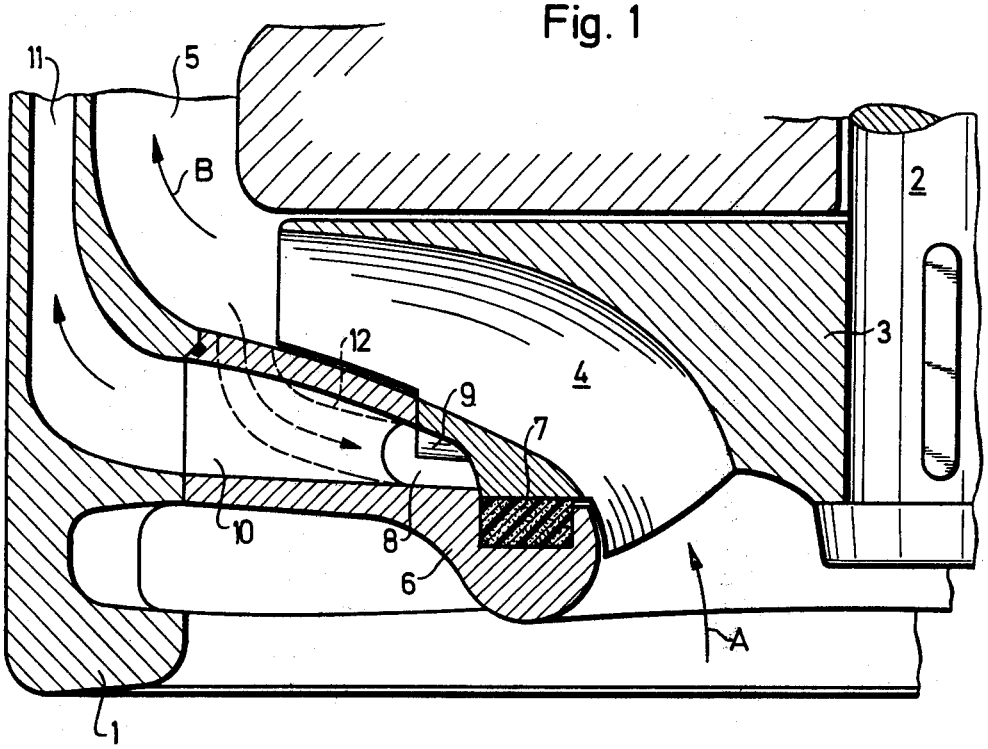

METHOD OF PUMPING LIQUID WITH A SUBMERGED ROTARY PUMP AND PUMP FOR CARRYING OUT THE METHOD

The present invention relates to a method for use when pumping liquid with a submerged rotary pump, for example, as is known in discharge systems from ship's tanks which are to be emptied as completely as possible, with the least possible residue.

The distance from the submerged pump to the deck of the ship can be substantial and the liquid column left in the riser pipe from the pump constitutes a not insignificant residue. The aim of the present invention is to remove this residue by simple means and, according to the invention, this is achieved in that, when the liquid level has sunk to the pump, the liquid in the riser pipe is caused to pass downwardly therein and into and up through a relatively narrow pipe leading from the pump housing on the pressure side of the impeller, the rotating impeller acting as a check valve for the liquid.

For example, the liquid-filled riser pipe can be subjected to gas pressure, preferably by means of compressed air, introduced into the riser pipe from above. The liquid in the riser pipe will then be pressed down and into and up through the narrow pipe. The rotating impeller acts as a check valve for the liquid.

For transport of the liquid from the riser pipe and up through the narrow pipe, an auxiliary pump rotating with the impeller may also be used, the suction side of the auxiliary pump opening at the pressure side of the impeller. The auxiliary pump then transports the liquid from the riser pipe and presses it upwards through the narrow pipe, and the rotating impeller also in this case acts as a check valve and prevents the liquid from draining into the tank.

A submergible pump for carrying out the said method is characterized in that a pipe leading from the pump housing is narrow with respect to the riser pipe, and in that the top of the riser pipe can optionally be connected to a source of pressurized fluid.

The submergible pump may to advantage be formed such that an auxiliary pump is provided in the pump housing, said pump rotating with the impeller, the inlet of said auxiliary pump opening at the pressure side of the impeller and the pressure side of the pump opening into a pipe which is narrow with respect to the riser pipe. Advantageously, the auxiliary pump may then be formed as a side channel pump, the blades of which are disposed on the impeller of the main pump.

Figure 2:
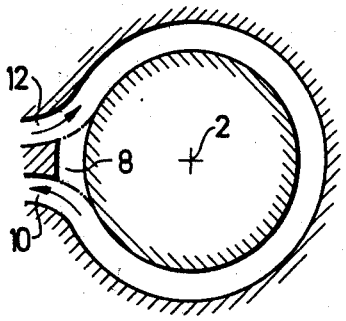

The invention is further explained in the following with reference to the drawing, where:

FIG. 1 is a partial section through a pump which can be used for carrying out the method according to the invention, and FIG. 2 shows, in diagram, the flow in the side channel pump illustrated in FIG. 1.

The section of a rotary pump illustrated in FIG. 1 may, for example, be a pump submergible in a ship's tank. Only the elements necessary to the understanding of the invention are illustrated.

The pump housing is signified by 1 and the drive shaft of the pump is signified by 2. An impeller 3 with blades 4 is mounted on the drive shaft. It is a centrifugal pump which is concerned here, which sucks in liquid as indicated by the arrow A and distributes liquid as indicated by the arrow B to a riser pipe 5 which, in this case, leads up to the ship's deck.

At the bottom of the pump housing 1, a terminating ring 6 is arranged which receives a packing 7 between the ring 6 and the impeller 3. Between the ring 6 and the impeller 3 there is an annular space 8 and, on the underside of the impeller 3, blades 9 are formed which form the blades in a side channel pump 8, 9. From the annular space 8 a channel 10 leads which opens into a pipe 11 which is narrow with respect to the riser pipe 5, said pipe 11 in this case being formed as a continuation of the pump housing and leading up to the ship's deck. In the ring 6, a further channel 12 is formed which, in FIG. 1, is indicated in broken lines and leads from the pressure side of the impeller 3 into the annular space 8. The direction of flow in the channel 12 is indicated by an arrow in broken lines and the flow direction in the channel 10 and the narrow pipe 11 is indicated by an arrow in the transition between the channel 10 and the narrow pipe 11.

FIG. 2 illustrates in diagram form how the inlet 12 and outlet 10 are arranged with respect to each other. The means in FIG. 1 acts in a manner such that when the liquid level has sunk to the pump, the side pump channel 8,9 transports the liquid from the riser pipe 5 and conducts it out through the channels 10 and up through the narrow pipe 11. The rotating impeller 3,4 acts as a check valve and facilitates the emptying of the riser pipe 5. In this manner, the entire amount of liquid located in the riser pipe, which is relatively substantial compared with the liquid amount which can be contained in the length of the narrow pipe 11, is removed.

According to the invention, it is essential that the rotary impeller acts as check valve for the liquid, and the liquid in the riser pipe 5 may optionally be pressed downwardly by being subjected, for example, to air pressure from above. The liquid will then be pressed up through the channel 12, the annular channel 8 out through the channel 10 and up through the narrow pipe 11. Optionally, the embodiment in FIG. 1 can be modified so that the channel 12 opens directly into the pipe 11, it being possible to omit the side channel pump illustrated in FIG. 1. The embodiment of FIG. 1, is, however, to be preferred if, for example, air pressure cannot be utilized, and expensive inert gas must be used instead, since it is possible to remove the liquid in the riser pipe 5 in a mechanical manner.

The relatively narrow pipe 11 can be formed with separate pipes or formed as an integral part of the riser pipe. The pipe may be very narrow since even with great lengths the amount of liquid remaining in the pipe will be relatively insignificant.

Having described my invention, I claim:

1. Method of pumping liquid by a submerged rotary pump that has an impeller that rotates about a vertical axis, said impeller having a pressure side to which said impeller delivers liquid upon rotation of said impeller, comprising rotating said impeller to pump the liquid up through a riser pipe until the liquid level has sunk to the pump, and thereafter causing the liquid in the riser pipe to pass down in bypass relation to the pump and into and up through a relatively narrow pipe which leads from the pump housing while continuing to rotate the impeller, thereby using the rotating impeller as check valve for the liquid.

2. Method of pumping liquid by a submerged rotary pump as in claim 1, comprising the step of subjecting the liquid-filled riser pipe to fluid pressure, from above.

3. Method of pumping liquid by a submerged rotary pump as in claim 1, comprising the step of using an auxiliary pump rotating with the said impeller, the suction side of the said auxiliary pump opening at the pressure side of the said impeller, the pressure side of the said auxiliary pump opening into the lower end of the said narrow pipe.

4. Submergible rotary pump comprising a pump housing and an impeller rotatable in the said pump housing about a vertical axis, said impeller having a pressure side to which said impeller delivers liquid upon rotation of said impeller, a riser pipe extending up from the said pump housing and communicating with the pressure side of said impeller, a pipe which is narrow with respect to the said riser pipe and extending up from the said pump housing, and means to direct liquid from the lower end of said riser pipe in bypass relation to said impeller and into the lower end of said narrow pipe.

5. Submergible rotary pump comprising a pump housing and an impeller rotatable in the said pump housing about a vertical axis, said impeller having a pressure side to which said impeller delivers liquid upon rotation of said impeller, a riser pipe extending up from the said pump housing and communicating with the pressure side of said impeller, a pipe which is narrow with respect to the said riser pipe and extending up from the said pump housing, and an auxiliary pump in the said pump housing rotating with the said impeller, the suction side of the said auxiliary pump being connected with the pressure side of the said impeller in bypass relation to said impeller and the pressure side of the said auxiliary pump being connected with the lower end of said narrow pipe.

6. Submergible rotary pump as in claim 5, the said auxiliary pump being a side channel pump the blades of which are disposed on the said impeller.

* * * * *